US009713880B2

(12) United States Patent
Haneda et al.

(10) Patent No.: US 9,713,880 B2
(45) Date of Patent: Jul. 25, 2017

(54) CHAINSAW

(71) Applicant: MAKITA CORPORATION, Aichi (JP)

(72) Inventors: Koji Haneda, Aichi (JP); Jiro Oda, Aichi (JP); Hideaki Sugiura, Aichi (JP); Daisuke Suzuki, Aichi (JP)

(73) Assignee: MAKITA CORPORATION, Aichi (JP)

( * ) Notice: Subject to any disclaimer, the term of this patent is extended or adjusted under 35 U.S.C. 154(b) by 6 days.

(21) Appl. No.: 14/765,141

(22) PCT Filed: Jan. 31, 2014

(86) PCT No.: PCT/JP2014/052272
§ 371 (c)(1),
(2) Date: Jul. 31, 2015

(87) PCT Pub. No.: WO2014/119733
PCT Pub. Date: Aug. 7, 2014

(65) Prior Publication Data

US 2015/0375416 A1 Dec. 31, 2015

(30) Foreign Application Priority Data

Feb. 1, 2013 (JP) ..... 2013-018674

(51) Int. Cl.
*H02J 7/00* (2006.01)
*B27B 17/02* (2006.01)
(Continued)

(52) U.S. Cl.
CPC ..... *B27B 17/02* (2013.01); *B25F 5/02* (2013.01); *B27B 17/00* (2013.01); *B27B 17/0008* (2013.01)

(58) Field of Classification Search
CPC .... B23D 47/025; B23D 47/00; B23D 45/042; B23D 45/48; B23D 49/16; B23D 49/162;
(Continued)

(56) References Cited

U.S. PATENT DOCUMENTS 5,028,858 A 7/1991 Schnizler et al.
9,132,491 B2 * 9/2015 Alberti ..... B23D 49/11
(Continued)

FOREIGN PATENT DOCUMENTS

JP 2011-136541 7/2011
JP 2011-161602 8/2011
JP 2011-218510 11/2011

OTHER PUBLICATIONS

International Search Report for PCT/JP2014/052272 having a mailing date of May 13, 2014, along with an English-language translation thereof.

(Continued)

*Primary Examiner* — Omar Flores Sanchez
(74) *Attorney, Agent, or Firm* — Greenblum & Bernstein, P.L.C.

(57) ABSTRACT

A chainsaw includes a body housing, an elongated guide bar projecting forward from the body housing, a saw-chain mounted on the periphery of the guide bar for rotation, an electric motor mounted within the body housing for rotating, and a top handle provided on an upper portion of the body housing above the guide bar and extending in a fore-and-aft direction. A plurality of rechargeable battery packs is mounted on the body housing as a source of power supply for the electric motor. The battery packs are mounted to the body housing in such a manner that a center of gravity of the chainsaw observed from the back side is positioned in a two times extent of lateral width of a gripe portion of the top handle at both sides of a vertical centerline of the gripe portion.

18 Claims, 12 Drawing Sheets

(51) Int. Cl.
*B27B 17/00* (2006.01)
*B25F 5/02* (2006.01)

(58) Field of Classification Search
CPC . B23D 51/10; B23D 51/00; B25F 5/00; B25F 5/02; B27B 17/02; B27B 17/00
USPC ..... 30/383, 381, 276; 173/46, 217; 320/107, 320/114, 112
See application file for complete search history.

(56) References Cited

U.S. PATENT DOCUMENTS

| | | | | |
|---|---|---|---|---|
| 2004/0098869 | A1* | 5/2004 | Ashfield | B27B 17/02 30/383 |
| 2011/0147031 | A1 | 6/2011 | Matthias et al. | |
| 2011/0162219 | A1 | 7/2011 | Okouchi | |
| 2011/0197389 | A1 | 8/2011 | Ota et al. | |
| 2011/0198103 | A1 | 8/2011 | Suzuki et al. | |
| 2013/0025893 | A1 | 1/2013 | Ota et al. | |
| 2013/0164589 | A1 | 6/2013 | Ota et al. | |
| 2014/0047722 | A1* | 2/2014 | Onose | B27B 17/00 30/383 |
| 2015/0273721 | A1* | 10/2015 | Harer | B23D 59/006 30/383 |

OTHER PUBLICATIONS

Extended European Search Report for EP 14745892.1 dated Feb. 8, 2016.

* cited by examiner

Fig. 8 ( a )
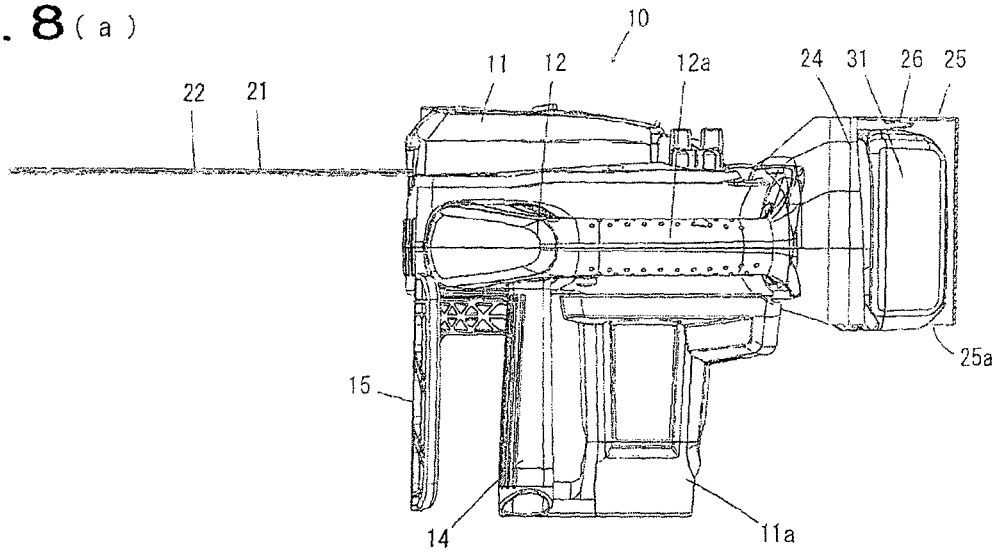
Fig. 8 ( b )
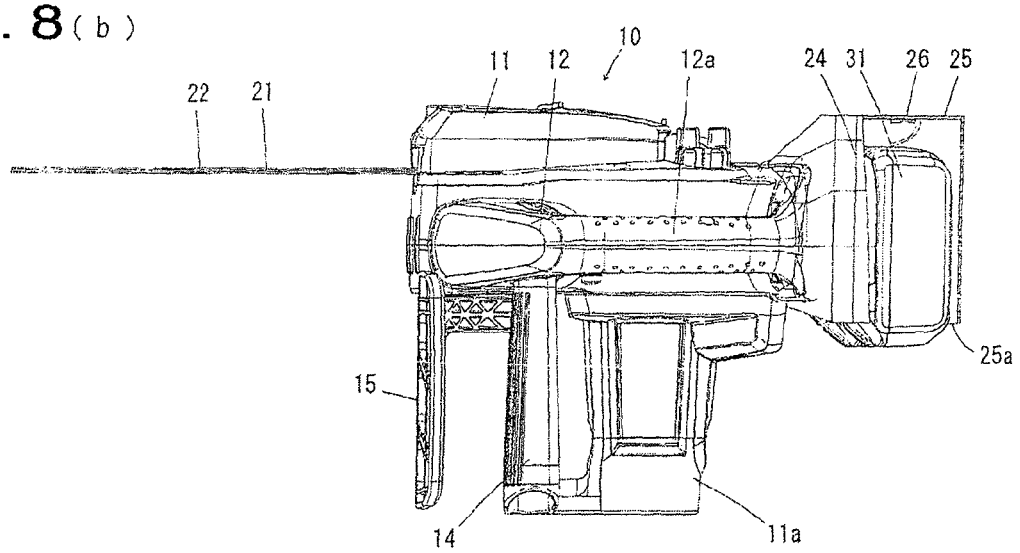

Fig. 12 ( a )
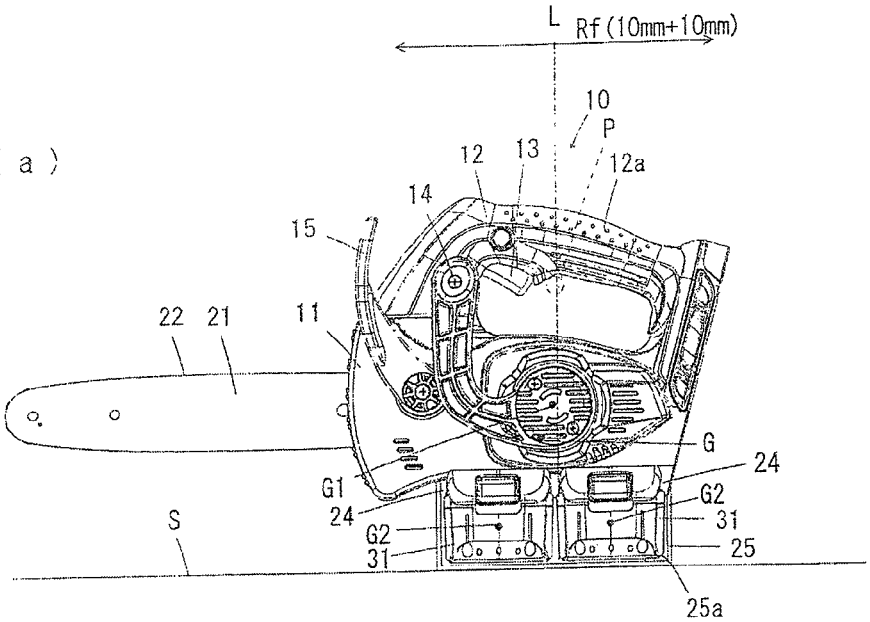
Fig. 12 ( b )
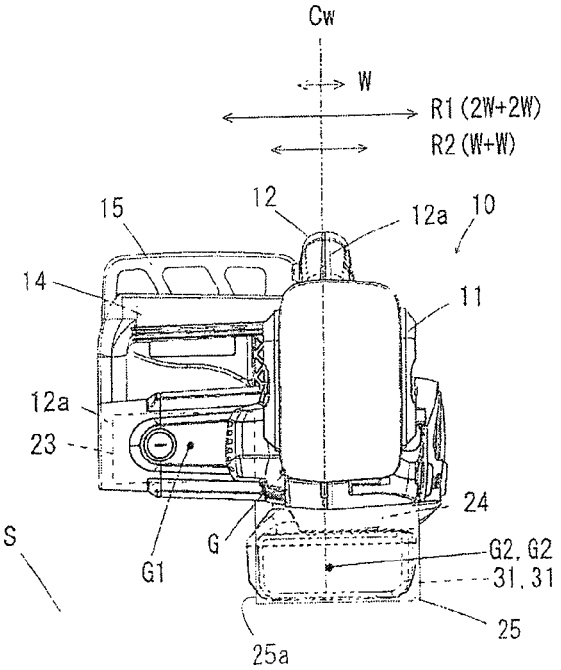

Fig. 13 ( a )
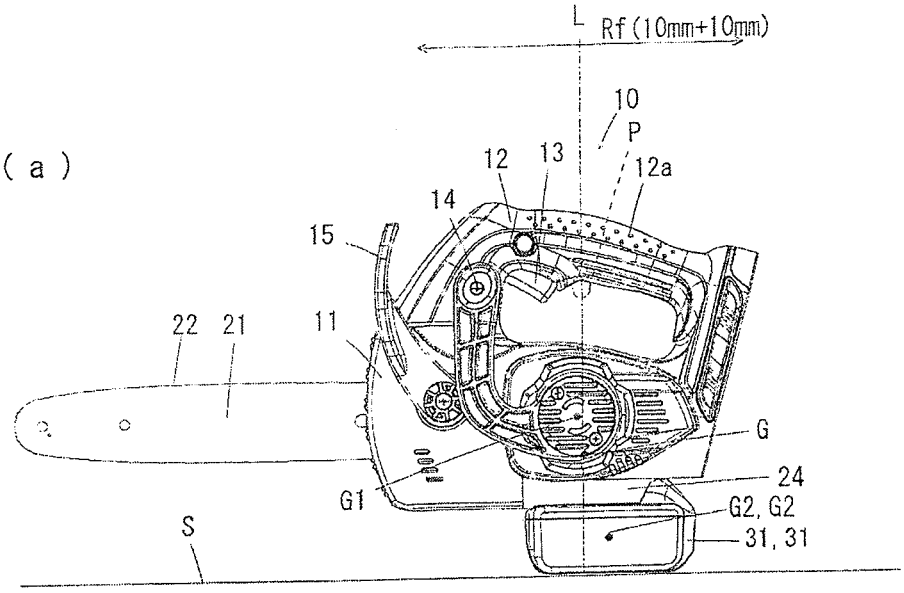
Fig. 13 ( b )
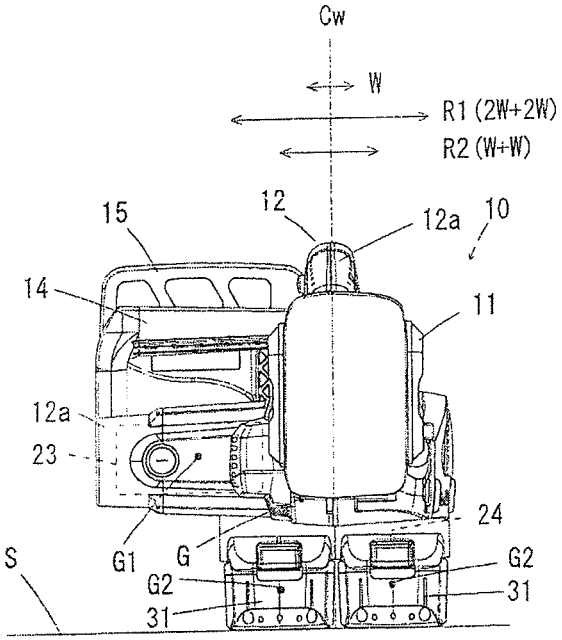

CHAINSAW

TECHNICAL FIELD

The present invention relates to a chainsaw of the type using a rechargeable battery pack.

TECHNICAL BACKGROUND

Disclosed in Japanese Patent Laid-open Publication No. 2011-136541 is a battery operated chainsaw of the type which comprises a body housing, an elongated guide bar projecting forward from the body housing, a saw-chain mounted to the periphery of the guide bar, and an electric motor driving the saw-chain along the guide bar. The body housing is provided at its rear portion with a detachable battery pack for supply of electric power to the motor. The chainsaw is provided with a top handle located on the upper portion of the body housing and extending in a fore-and-aft direction above the guide bar, and a front handle across the top handle and extending in a left-and-right direction. The top handle is provided at its interim portion with a gripe portion to be grasped by an operator and with a trigger switch located under the gripe portion.

In use of the chainsaw, an operator grasps the top handle by his right hand and holds the front handle by his left hand. When the trigger switch is operated by the right hand of the operator to activate the electric motor, the saw-chain is driven by operation of the motor for rotation around the guide bar and is brought into contact with the log for cutting.

In the chainsaw, the electric motor is supplied with electric power from the single battery pack mounted to the rear portion of the body housing. The battery pack is, in general, in the form of a large size battery pack of high voltage (for instance, 36V) for driving the high power motor. The large size battery pack of high voltage is, however, expensive and limited only for use in the chainsaw. In other words, the large size battery pack may not be used as a source of electricity for other work apparatus such as electric power tools. In this respect, it is assumed to utilize a plurality of small size battery packs adapted for use in electric power tools as the source of power supply for chainsaws in order to avoid necessity for having various kinds of battery packs. However, if the battery packs were not mounted on an appropriate place of the body housing, the chainsaw would be inclined in a left-and-right direction to deteriorate operability of the chainsaw. It is, therefore, an object of the present invention to provide a battery operated chainsaw superior in operability, in which a plurality of small size batteries are used as a source of power supply.

SUMMARY OF THE INVENTION

According to the present invention, the object is accomplished by providing a chainsaw of the type which comprises a body housing, an elongated guide bar projecting forward from the body housing, a saw-chain mounted to a periphery of the guide bar for rotation, an electric motor mounted within the body housing for rotating the saw-chain along the periphery of the guide bar, a top handle extending in a fore-and-aft direction on the upper portion of the body housing above the guide bar and being provided at its interim portion with a gripe portion grasped by an operator, a plurality of rechargeable battery packs detachably mounted on the body housing as a source of power supply to the electric motor, the battery packs being adaptable for use as a source of power supply to electric power tools, wherein a center of gravity of the chainsaw observed from the back side is positioned in an extent of two times of lateral width of the gripe portion at both sides of a vertical centerline of the gripe portion, preferably in an extent of the same width as the lateral width of the gripe portion.

As in the chainsaw, the battery packs are arranged in such a manner that a center of gravity of the chainsaw observed from the back side is positioned in an extent of two times of lateral width of the gripe portion at the both sides of a vertical centerline of the gripe portion, preferably in an extent of the same width as the lateral width of the gripe portion, the chainsaw is not apt to be inclined in a left-and-right direction when the gripe portion of the top handle was grasped by an operator to hold the chainsaw. This is useful to reduce fatigue of the operation.

In the chainsaw, it is preferable that the center of gravity of the chainsaw observed from the back side is offset in a left-and-right direction from the vertical centerline in the extent described above. With such arrangement of the center of gravity, the chainsaw is slightly inclined in the left-and-right direction to enhance operability of the chainsaw. In the chainsaw, it is also preferable that the center of gravity of each battery pack is positioned in the extent described above.

In the chainsaw, it is also preferable that the battery packs are arranged in such a manner that the center of gravity of the chainsaw observed from the side of the chainsaw is positioned in an extent of 100 mm at both the front and rear sides from a vertical straight line passing through an immediately rear position of the trigger switch. This is useful to prevent the chainsaw from being largely inclined when the top handle was grasped by the operator to hole the chainsaw. This means that it is unnecessary to strongly grasp the gripe portion and that fatigue of the operator is reduced.

In the case that the chainsaw is provided with two battery packs, it is preferable that each center of gravity of the two battery packs is positioned at left and right sides of a vertical centerline extending from the gripe portion to adjust balance of the chainsaw in a left-and-right direction.

In the case that a plurality of battery packs is mounted to the bottom of the body housing, it is preferable that the center of gravity of the chainsaw is positioned at an upper side of an extent of battery packs observed from a vertical direction. With such arrangement of the battery packs, the chainsaw is retained in place without falling down when the battery packs were grounded to place the chainsaw on the ground.

In the case that a plurality of battery packs is mounted to a lower portion the body housing in such manner that the center of gravity of the chainsaw is positioned between the lower portion of body housing and battery packs grounded in a condition where the chainsaw was placed on the ground. With such arrangement of the battery packs, the chainsaw is retained in place without falling down.

Preferably, the chainsaw is provided with a protector member formed to cover the battery packs when the chainsaw is placed on a horizontal support place. The protector member is useful to avoid damage caused by contact with the ground.

In the chainsaw, it is preferable that the battery packs are arranged in parallel to facilitate operation of an operator for attachment or removal. In the case that the battery packs arranged in parallel with a space more than 15 mm, each battery pack can be easily grasped for attachment or removal. In the case that the volume of each battery pack is more than 200 $cm^3$, the space between the battery packs arranged in parallel is determined to be 15 mm for reducing the space occupied by the battery packs.

In the chainsaw, it preferable that a plurality of attachments is provided for mounting the battery packs. The battery packs each includes a casing containing a plurality of cells therein, an electric connector provided on one-side wall of the casing, and a pair of rails arranged at opposite sides of the electric connector. The attachment is provided with a pair of guide rails for engagement with the rails of the battery pack. The rails of the battery pack are slideably engaged with the guide rails of the attachment to facilitate mounting operation of the battery packs. The battery packs each have a hook retractably projected, while that attachment is provided with a latch to be engaged with the hook. When the hook of the battery pack is brought into engagement with the latch of the attachment, the battery pack is fixed in place to the attachment. In the case that the attachment is provided with a resilient member for biasing the battery pack along the guide rails in a removal direction, the battery pack is removed from the attachment under biasing force of the resilient member when the hook is disengaged from the latch. The attachment may be provided with a batter pack container enclosing the periphery of the battery pack and having an insert opening formed to permit insertion of the battery pack along the guide rails and outward movement of the battery pack caused by biasing force of the resilient member when the hook is disengaged from the latch.

In the chainsaw, the battery packs are electrically connected in series with the electric motor to cause high output power. When the battery packs are electrically connected in parallel with the electric motor, activation of the electric motor is maintained for a long period of time

BRIEF DESCRIPTION OF THE DRAWINGS

In the drawings:

FIGS. 8(*a*) and 8(*b*) are a partly broken sectional view of a modification of the chainsaw, wherein FIG. 8(*a*) is a partly broken sectional view showing a condition where battery packs are contained in a battery pack container, and wherein FIG. 8(*b*) is a partly broken section view showing a condition where the battery packs are moved downward from an insert opening under biasing force of a resilient member;

FIGS. 12(*a*) and 12(*b*) illustrate a modification 5 of the chainsaw, wherein FIG. 12(*a*) is a left side view and wherein FIG. 12(*b*) is a back view;

FIGS. 13(*a*) and 13(*b*) illustrate a modification 6 of the chainsaw, wherein FIG. 13(*a*) is a left side view and wherein FIG. 13(*b*) is a back view;

PREFERRED EMBODIMENTS OF THE INVENTION

Figure 1:
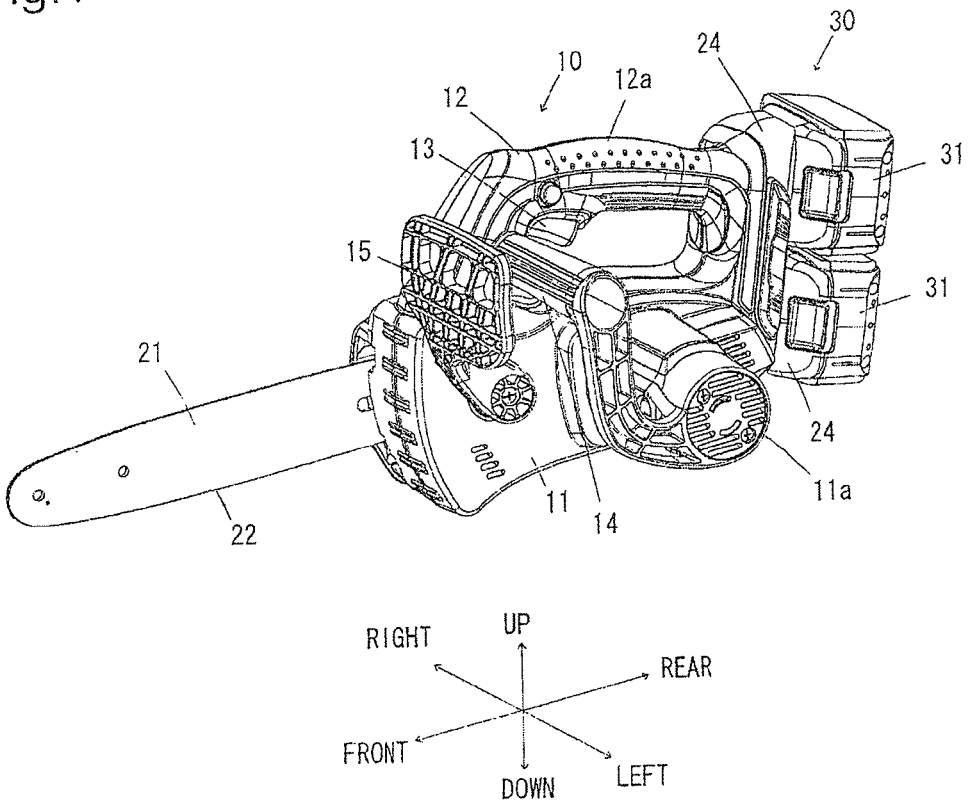
FIG. 1 is a perspective view of a chainsaw in a preferred embodiment of the present invention.
Figure 2:
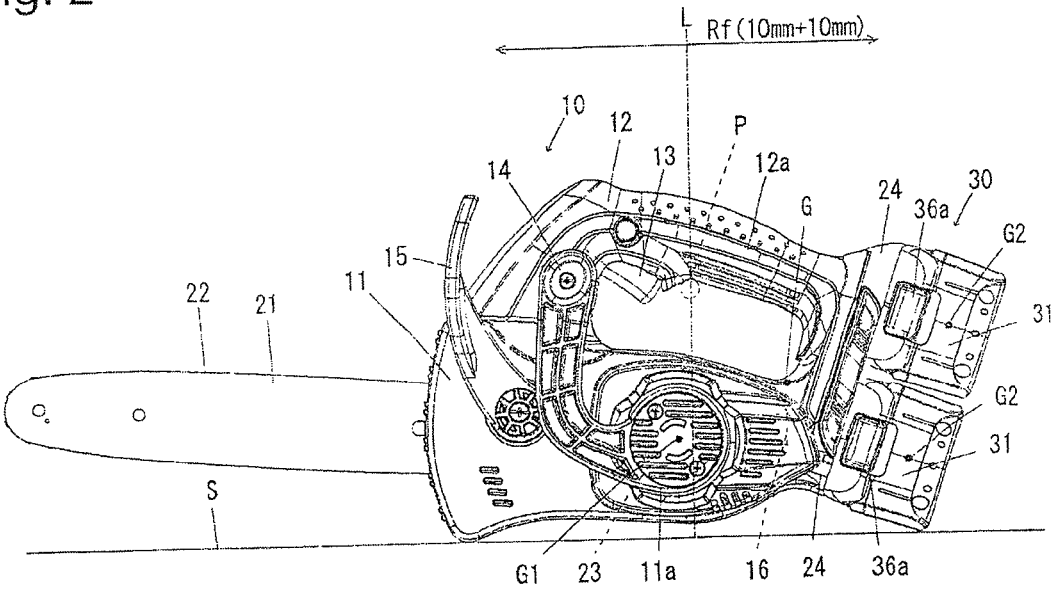
FIG. 2 is a left side view of the chainsaw shown in FIG. 1.
Figure 3:
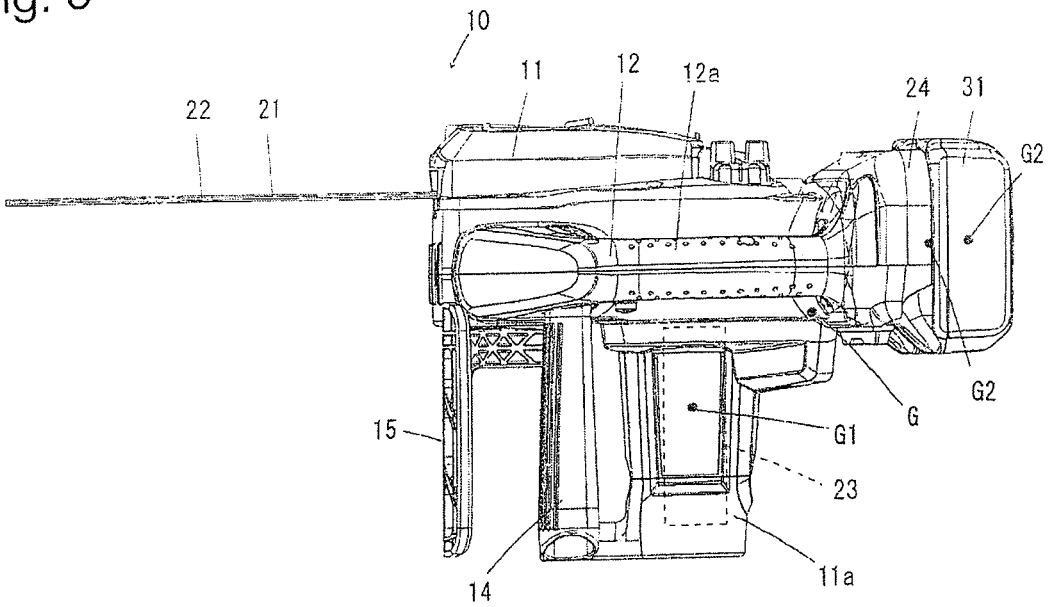
FIG. 3 is a plan view of the chainsaw shown in FIG. 1.

Hereinafter, a preferred embodiment of a chainsaw in accordance with the present invention will be described with reference to the accompanying drawings. As shown in FIGS. 1~3, the chainsaw 10 includes a body housing 11, an elongated guide bar 21 mounted to a front portion of the body housing 11 and projected forward, and a saw-chain 22 of loop type mounted on the periphery of the guide bar 21 for rotation. The saw-chain 22 is stretched over the guide bar 21 and a drive sprocket (not shown) mounted within the body housing 11 at a immediately rear side of guide bar 21 for rotation. The saw-chain 22 is provided with a plurality of cutting teeth in a conventional manner.

As shown in FIG. 1, the body housing 11 is at its left-side portion with a leftward extruded container portion 11*a* in which an electric motor 23 is mounted to drive the saw-chain 22 for rotation along the periphery of guide bar 21. The sprocket is connected to an output shaft of the motor 23 to be driven for rotating the saw-chain 22 along the periphery of guide bar 21.

As shown in FIGS. 1-3, a top handle 12 is longitudinally provided on an upper portion of body housing 11 and located above the guide bar 21. A front handle 14 is provided laterally on a front portion of body housing 11. The top handle 12 has a gripe portion 12*a* at its interim portion in a longitudinal direction to be grasped by an operator. The width of gripe portion 12*a* is 30 mm suitable for grasping. The width of gripe portion 12*a* may be 25 mm~40 mm in necessity. A trigger switch 13 is provided under the front of gripe portion 12*a* to be operated for activating the electric motor 23. The front handle 14 is fixed at its proximal end to the front portion of top handle 12 and extended laterally in a direction perpendicular across the top handle 12. The distal end of front handle 14 is extended downward and fixed to the motor containing portion 11*a* of body housing 11. A hand guard 15 is provided at the front side of front handle 14 to deactivate the electric motor. 23 when it is inclined forward. An oil tank 16 is provided within an interim portion of body housing 11 to store an amount of lubrication oil thereby to supply lubrication oil to the sprocket and saw-chain 22.

Figure 4:
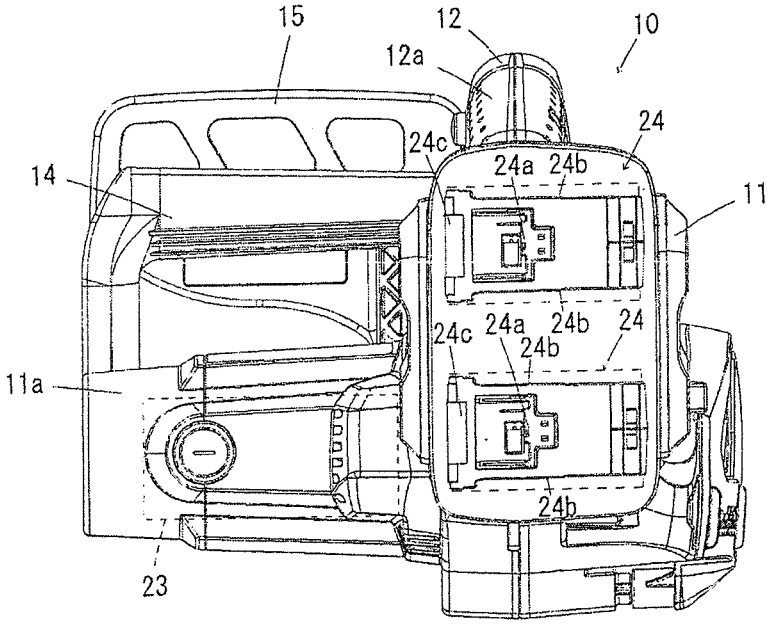
FIG. 4 is a back side view of the chainsaw in a condition where battery packs were removed.

As shown in FIGS. 1~3, a source of power supply 30 for the electric motor 23 is detachably mounted to the back portion of body housing 11. In this embodiment, the source of power supply 30 is in the form of a set of two battery packs 31 vertically in parallel. FIG. 4 illustrates the back portion of the body housing in a condition where the battery packs 31 were removed. As shown in FIG. 4, a set of two attachments 24, 24 for battery packs 24, 24 is vertically in parallel mounted to the back portion of body housing 11. The attachments 24, 24 each provided with a connector portion 24*a* to be connected to an electric connector 34 of battery pack 31 for electrically connecting the battery pack to the electric motor 23. A pair of guide rails 24*b* is provided at both sides of the connector portion 24 for mounting the battery packs by leftward slide movement.

The attachment 24 is provided with an inward concaved latch portion 24*c* to be engaged with a hook 36 of battery pack 31. When engaged with the latch portion 24*c*, the hook 36 restricts slide movement of the battery packs 31 along the guide rails 24*b*, 24*b*.

The battery packs 31 each are used as a source of power supply for electric motor 23 and charged by a charger (not shown). The battery packs 31 can be adapted to use a source of power supply for electric power tools such as an electric power driver, an electric power cutter. In this embodiment, the nominal voltage of the battery pack 31 is 18V, and the two battery packs 31, 31 are connected in series with the electric motor 23.

Figure 6:
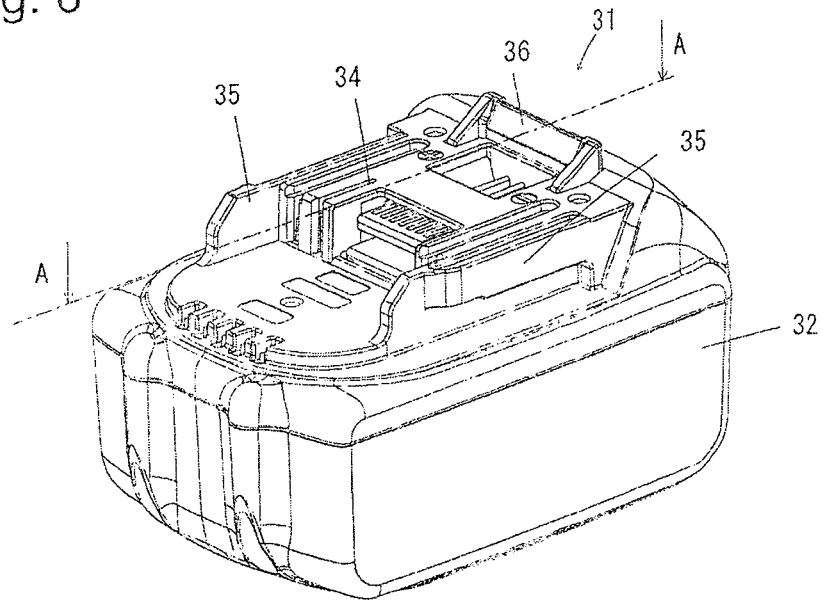
FIG. 6 is a perspective view of the battery pack shown in FIG. 5.
Figure 7:
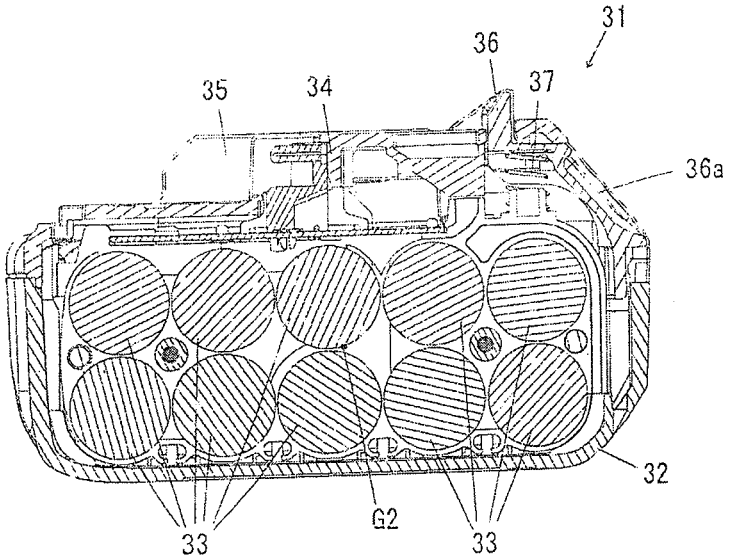
FIG. 7 is a sectional view taken along A-A line in FIG. 6.

As shown FIGS. 6 and 7, the battery pack 31 is comprised of a rectangular casing 32 containing therein ten pieces of cylindrical battery cells 33. The battery packs 31 are mounted to the attachment 24 by slide movement in its longitudinal direction. The battery cells 33 are contained in the casing 32 perpendicular to the slide direction of battery packs 31. The center of gravity of battery pack 31 is positioned approximately at the center of casing 32.

The upper wall of casing 32 shown in FIG. 6 is formed to oppose to the attachment 24 and is provided with an electric connector 34. As described above, the electric connector 34 is detachably connected to the connector portion 24*a* of attachment 24. As shown in FIG. 6, the upper wall of casing 32 is formed integrally with a pair of longitudinal rails 35, 35. These rails 35, 35 are located at opposite sides of electric connector 34 in a direction perpendicular to the longitudinal direction of casing 32. The hook 36 is formed on the upper wall of casing 32 and projected toward the attachment 24. The hook 36 is biased by a resilient member (spring) 37 toward the latch portion 24*c* of attachment 24. When the hook 36 is engaged with the latch portion 24*c* of attachment 24, the battery packs 31, 31 are retained in place on the guide rails 24*b*, 24*b*, and the electric connector 34 is engaged with the connector portion 24*a* of attachment 24. When a release button 36*a* is pushed against the biasing force of resilient member 37, the hook 36 is disengaged from the latch portion 24*c* to permit slide movement of the battery packs 31 along the guide rails 24*b*, 24*b*. Thus, the battery packs 31 can be removed from the attachment 24.

In the chainsaw 10, a set of two rechargeable battery packs 31, 31 adapted to use in electric power tools is utilized as the source of power supply 30 for electric motor 23. Accordingly, it is not needed to hold different kinds of battery packs for use in the chainsaw 10 and the electric power tool.

The center of gravity G of the chainsaw is determined in consideration with respective positions of heavy articles such as the electric motor 23, oil tank 16, guide bar 21, battery packs 31 and the like. If the center of gravity G is in an unsuitable position, the operability of the chainsaw is deteriorated.

When an operator grasped the gripe portion of the chainsaw with his right hand to hold the chainsaw, he operates the trigger switch with his right hand forefinger to activate the electric motor. Accordingly, the weight of the chainsaw is supported mainly by the middle finger of his right hand. In the present invention, the battery packs 31, 31 are weight balance of the chainsaw in a fore-and-aft direction and a left-and-right direction is obtained at a position P. immediately rear of the trigger switch 13.

Figure 5:
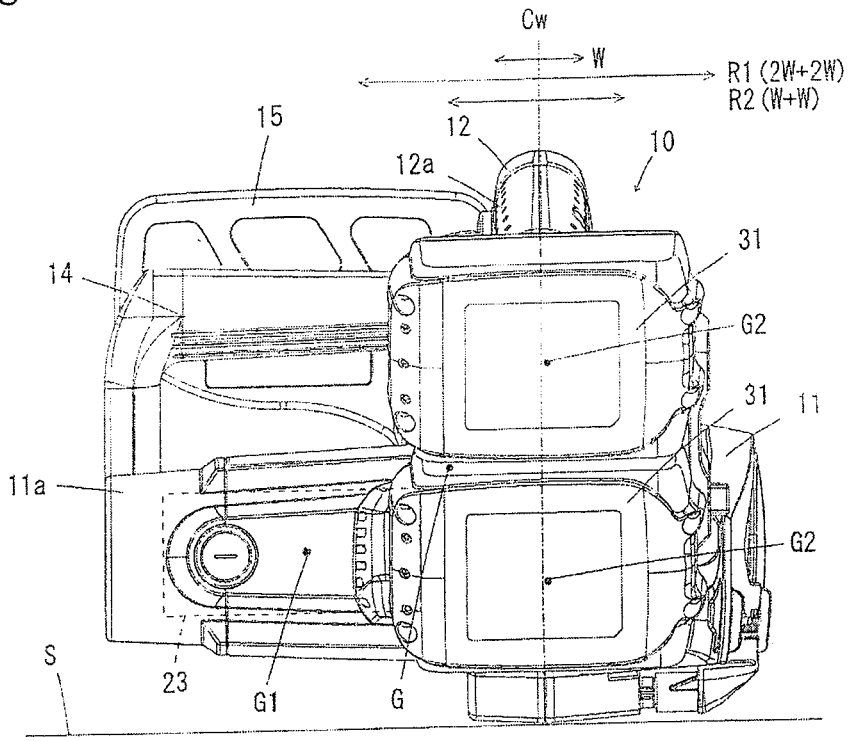
FIG. 5 is a back side view illustrating a center of gravity observed from the back side of the chainsaw.

In the chainsaw 10, the width of body housing 11 including the motor containing portion 11*a* is 220 mm, and the width of body housing 11 without the motor containing portion 11*a* is 140 mm. As shown in FIG. 5, the two battery packs 31, 31 are arranged at a slightly right side of the back portion of body housing 11 such that the center of gravity G observed from the back side is positioned at the left side of a vertical centerline Cw of gripe portion 12*a* in an extent R (R1) of two times the width W (30 mm) of gripe portion 12*a*. In this embodiment, the battery packs 31, 31 are arranged in such a manner that the center of gravity G1 of electric motor 23 is located at the left side of the centerline Cw of gripe portion 12*a*, while each center of gravity G2, G2 of battery packs 31, 31 is located at the right side of centerline Cw. With such arrangement of the battery packs, the chainsaw is held by the operator's hand without lateral inclination when the grip portion 12*a* of top handle 12 was grasped. Thus, it is unnecessary to firmly grasp the gripe portion 12*a*. In the case that the center of gravity G observed from the back side is positioned at both left and right sides of the vertical centerline Cw of the gripe portion 12*a* in an extent R (R2) of the width (30 mm) of the gripe portion, the chainsaw is surely held without lateral inclination.

In the chainsaw 10, the center of gravity G observed from the back side is located at a position P immediately rear side of trigger switch 13 and offset to the left side of the front handle 14 in an extent R (R1, R2) from the vertical centerline Cw. With such arrangement, the center of gravity G of the chainsaw 10 is positioned between both hands of the user in a condition where the top handle was grasped by his right hand and the front handle was grasped by his left hand. This is useful to reduce fatigue of the operator. Alternatively, the center of gravity G observed from the back side is located at the position P and offset to the right side of the front handle 14 in the extent R (R1, R2).

In the chainsaw, the fore-and-aft length of the body housing 11 with the battery packs 31, 31 is 300 mm, and the width of the body housing 11 without the battery packs is 250 mm. As shown in FIG. 2, the trigger switch 13 for electric motor 23 is located at the front part of gripe portion 12*a*, and the two battery packs 31, 31 are mounted to the back portion of body housing 11 in such a manner that the center of gravity G observed from the left side of chainsaw 10 is positioned in a fore-and-aft extent Rf of 100 mm at both sides of a vertical straight line L passing an immediately back position P of trigger switch 13. With such arrangement of the battery packs 31, 31, the chainsaw 10 may not be inclined in a fore-and-aft direction. It is, therefore, unnecessary for an operator to strongly grasp the gripe portion 12*a*.

When the chainsaw is used for cutting the tree, log and the like, the guide bar 21 is directed upward at its distal end and compressed to the log from the upper slant side. In this embodiment, the center of gravity G of the chainsaw observed from the side is positioned at the rear side in the fore-and-aft extent Rf from the vertical straight line L passing the back position P of trigger switch 13. Thus, when the gripe portion 12 was grasped by an operator, the guide bar 21 of chainsaw 10 is directed slightly upward at its distal end. This is useful to reduce the load acting on the operator in working for cutting the tree, log and the like.

As shown in FIG. 2, the chainsaw 10 is placed on a horizontal support surface S of ground in a condition where the front-side lower portion of the body housing 11 and the lower-side battery pack 31 are grounded. In such a situation, the center of gravity G of the chainsaw is positioned between the grounded portions of body housing 11 and lower-side battery pack 31. Thus, the chainsaw is placed on the ground without falling in a fore-and-aft direction.

In the chainsaw 10, the two battery packs 31, 31 are arranged vertically in parallel. This is useful to enhance operability for detachment of the battery packs, when compared with arrangement of the battery packs spaced to one another. In the case that the volume of battery pack 31 is 540 $cm^3$ more than 200 $cm^3$, it is preferable that the space between two battery packs 31, 31 is determined less than 15 mm. In this embodiment, the space between the battery packs 31, 31 is determined to be 5 mm for reducing the space occupied by the battery packs.

In the chainsaw 10, two attachments 24, 24 for the battery packs 31, 31 are mounted to the back portion of body housing 11. The battery packs 31, 31 each are composed of a casing 32 containing therein battery cells 33, an electric connector 34 provided on a peripheral wall of casing 34, and a pair of rails 35, 35 arranged at opposite sides of the electric connector 34. The attachments 24, 24 each are provided thereon with a pair of guide rails 24*b*, 24*b* to be brought into engagement with the pair of rails 35, 35. With such arrangement, the pair of rails 35, 35 of battery pack 31 can be mounted to the guide rails 24*b*, 24*b* of attachment 24 by slide movement to facilitate mounting operation of the battery packs to the attachment 24.

The battery pack 31 has a hook 36 retractably projected, while the attachment 24 is provided with a latch portion 24*c* to be engaged with the hook 36. When the hook 36 of battery pack 31 is brought into engagement with the latch portion 24*c*, the battery pack is fixed in place to the attachment 24. This is useful to enhance operability for mounting the battery packs 31 to the attachment 24.

Hereinafter, modifications of the chainsaw using a set of two battery packs will be described. In the following description, modification different from the embodiment of chainsaw 10 will mainly be described.

Modification 1

In a modification 1 of the chainsaw shown in FIG. 8, the attachment 24 within the body housing 11 is provided with a container 25 enclosing the periphery of battery packs 31, 31 to prevent adherence of contaminants thereto. The battery pack container 25 is formed at its one side wall with an insert opening 25*a* for the battery packs 31. When the battery packs 31, 31 each are inserted into the container 25 through the opening 25*a* and shifted inward along the guide rails 24*b*, 24*b*, the hook 36 is engaged with the latch portion 24*c* of attachment 24 to retain the battery packs 31 in place on attachment 24.

The attachment 24 is provided with a resilient member 26 biasing outward the battery packs 31 from the container 25. When it is desired to remove the battery packs, the release button 36*a* is pushed to disengage the hook 36 from the latch portion 24*c*. Thus, as shown in FIG. 8(*b*), the battery packs 31, 31 are moved outward through the insert opening 25*a* under the biasing force of resilient member 26 and removed by a user from the container portion 25. Although both the battery packs 31, 31 are contained in the container 25, a single battery pack 31 may be contained in the container 25. Alternatively, a plurality of containers corresponding with the number of battery packs may be provided.

Modification 2

Figure 9:
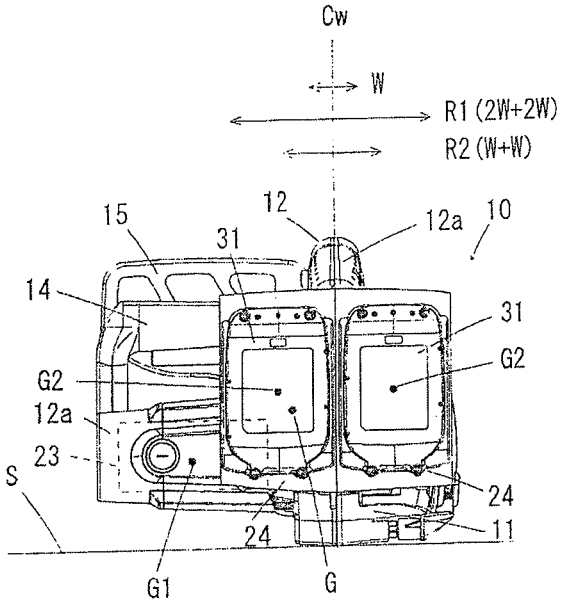
FIG. 9 is a back view of a modification 2 of the chainsaw.

As shown in FIG. 9, the battery packs 31, 31 may be arranged vertically in parallel on the back portion of body housing 11. In this modification, the two attachments 24, 24 are provided laterally in parallel on the back portion of body housing 11, and the pair of guide rails 24*b*, 24*b* is provided vertically at the both sides of each connector 24*a* of attachments 24, 24. Thus, the battery packs 31, 31 are mounted in place by downward slide movement along the guide rails 24*b*, 24*b*

With such arrangement of the battery packs, each center of gravity G2 is positioned at left and right sides of the vertical centerline Cw in a condition where the center of gravity G of the chainsaw is in the extent described above. This is useful to ensure balance of the chainsaw in a left-and-right direction. In this modification 2, the battery pack container 25 and resilient member 26 may be provided as in the modification 1.

Modification 3

Figure 10:
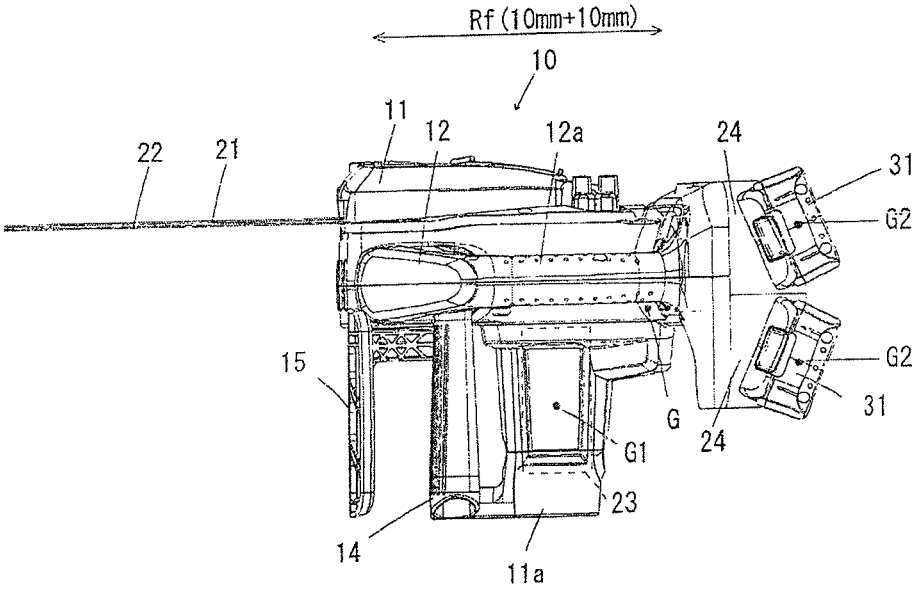
FIG. 10 is a plan view of a modification 3 of the chainsaw.

As shown in FIG. 10, the battery packs 31, 31 are mounted in parallel on the back portion of body housing 11 in such a manner that the opposed side walls of battery packs 31, 31, are widely spaced at their rear portions.

With such arrangement of the battery packs 31, 31, the space between the opposed side walls can be determined to be more than 15 mm, thereby to facilitate removal of the battery packs. Thus, the operability for detachment of the battery packs is enhanced. The same useful effect as in the modification 2 is obtainable. In this modification 3, the battery pack container 25 and resilient member 26 may be provided as in the modification 1.

Modification 4

Figure 11A:
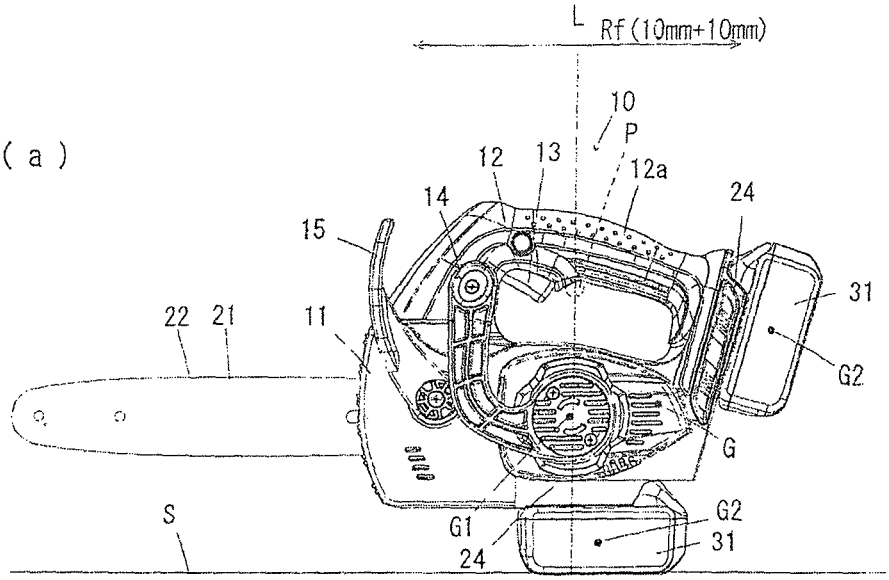
FIGS. 11(*a*) and 11(*b*) illustrate a modification 4 of the chainsaw, wherein FIG. 11(*a*) is a left side view and wherein FIG. 11(*b*) is a back view.
Figure 11B:
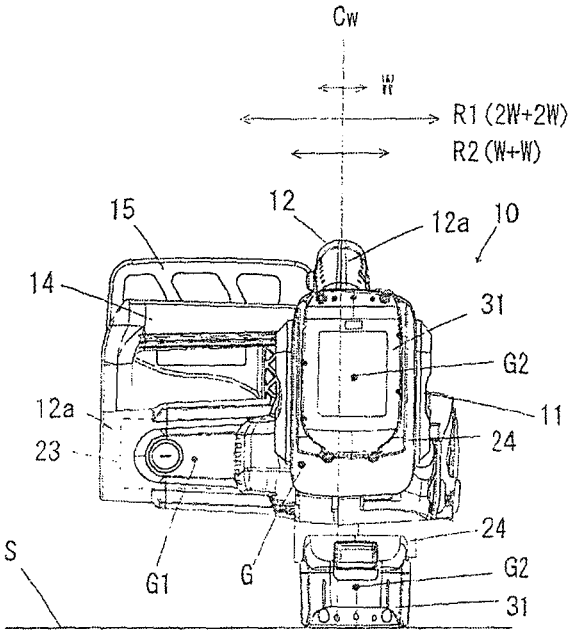

As shown in FIG. 11, one of the battery packs 31 is vertically mounted to the back portion of body housing 11, while the other battery pack 31 is horizontally mounted to the bottom portion of body housing 11. The former battery pack 31 can be mounted in place by downward slide movement, while the latter battery pack 31 can be mounted in place by forward movement. Each center of gravity G2, G2 of battery packs 31, 31 is located in a position displaced slightly rightward from the centerline Cw of gripe portion 12*a*. In addition, the former battery pack 31 may be arranged to be mounted by slide movement in a left-and-right direction. Similarly, the latter battery pack 31 may be arranged to be mounted by slide movement in a left-and-right direction. In this modification 4, the battery pack container 25 and resilient member 26 may be provided as in the modification.

Modification 5

As shown in FIG. 12, the battery packs 31, 31 may be mounted in parallel to the bottom portion of body housing 11. The two attachments 24, 24 are provided in parallel within the bottom portion of body housing 11. The guide rails 24*b*, 24*b* extending in a left-and-right direction are provided at both sides of the connector 24*a* of attachment 24 in a fore-and-aft direction. Thus, the battery packs 31, 31 are mounted in place by rightward slide movement along the guide rails 24*b*, 24*b*. Each center of gravity G2 of the two battery packs 31, 31 is displaced slightly right side from the centerline Cw of gripe portion 12*a*. The battery packs 31, 31 are arranged in such a manner that the center of gravity G of the chainsaw 10 is positioned above in an extent of battery packs 31, 31. Thus, when the chainsaw was placed in such a manner that the battery packs 31, 31 are in contact with the ground, the chainsaw is retained in place without falling down.

As in the modification 1, the body housing 11 is provided with a battery pack container 25 enclosing the periphery of battery pack 31. As described above, the container 25 is useful to prevent adherence of contaminant and to cover a portion of the battery packs exposed to ground when the chainsaw is placed on the support surface S. The container 25 is also useful to prevent damage of the battery packs caused by impact. It is preferable that the battery pack container 25 is made of thick sheet metal. In this modification 5, the resilient member 26 may be provided within the battery pack container 25 as in the modification.

Modification 6

As shown in FIG. 13, the battery packs 31, 31 are mounted in parallel to the bottom of body housing 11 in a left-and-right direction, and the two attachments 24. 24 are mounted in parallel to the bottom of body housing 11. The pair of guide rails 24*b*, 24*b* extends in a fore-and-aft direction at the both sides of each connector 24*a* of the attachment 24. Thus, the battery packs 31, 31 are mounted in place by forward slide movement along the guide rails 24*b*. With such arrangement of the battery packs 31, 31, each center of gravity G2 of the battery packs 31, 31 is positioned at left and right sides of the vertical centerline Cw in the extent R, and the center of gravity G of the chainsaw is positioned at an upper side in the extent of battery packs. Thus, when the chainsaw was placed in such a manner that the battery packs 31, 31 are in contact with the ground, the chainsaw is retained in place without falling down. In this modification 6, the battery pack container 25 and resilient member 26 may be provided as in the modification 1.

Modification 7

Figure 14:
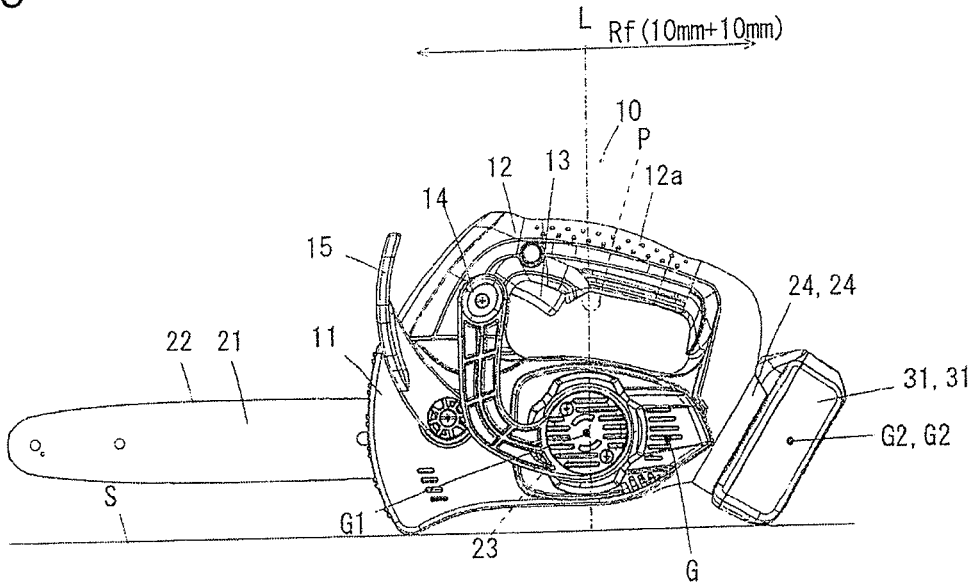
FIG. 14 is a left side view of a modification 7 of the chainsaw.

As shown in FIG. 14, the battery packs 31, 31 are mounted in parallel in a left-and-right direction under the back portion of body housing 11, and the two attachments 24, 24 are provided on the back portion of body housing to couple the battery packs with the electric motor. The pair of guide rails 24*b*, 24 is provided vertically at both sides of the connector 24 in a left-and-right direction. Thus, the battery packs 31 are mounted to the attachment by downward slide movement in a forward inclined direction along the guide rails 24*a*, 24*a*. In this modification, the battery pack container 25 and resilient member 26 may be provided as in the modification 1.

Modification 8

Figure 15:
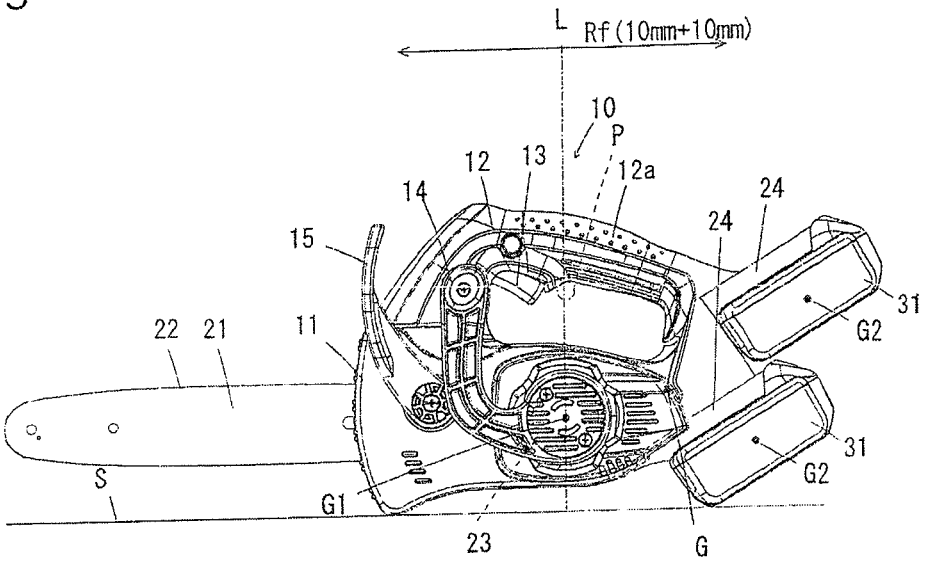
FIG. 15 is a left side view of a modification 8 of the chainsaw.

As shown in FIG. 15, the battery packs 31, 31 may be mounted vertically in parallel to the back portion of body housing 11 in such a manner that both the battery packs 31, 31 are inclined upward at their rear sides. The two attachments 24, 24 are provided vertically in parallel on the back portion of body housing 11. The pair of guide rails 24*b*, 24*b* are provided at both sides of the connector 24*a* in a left-and-right direction. Thus, the battery packs 31 are mounted to the attachments by downward slide movement in a forward inclined direction along the guide rails 24*a*, 24*a*.

Although in the chainsaw described above, the two battery packs 31. 31 are electrically connected in series with the electric motor 23 for supply of high power, the two battery packs 31, 31 may be electrically connected in parallel with the electric motor 23 for supply of power for a long period of time. A control circuit may be provided to select the series connection or the parallel connection to the electric motor 23.

Although in the chainsaw 10, a battery pack of nominal 18V is used as the battery pack, a battery pack larger or smaller in size than the battery pack may be used. Although in the above embodiment, two battery packs of the same volume and the same weight are used, another battery pack of different volume and different weight may be used in an appropriate combination.

Although in the above embodiments, various arrangements of the battery packs are illustrated, the arrangement of the battery packs is not limited to the foregoing embodiments. For example, one of the battery packs 31 may be mounted to the left side wall of the body housing 11 under the hand-guard 15, while the other battery pack may be mounted to the right side wall of the body housing 11.

In the case that a plurality of battery packs 31 is electrically connected in series, it is preferable to provide a battery controller for controlling each voltage of the battery packs. In the case that a battery controller and a motor controller are united to reduce the number of component parts, the occupation space and required wiring, the same microcomputer may be adapted to control operation of the electric motor 23 and voltage of the battery packs 31.

Figure 16:
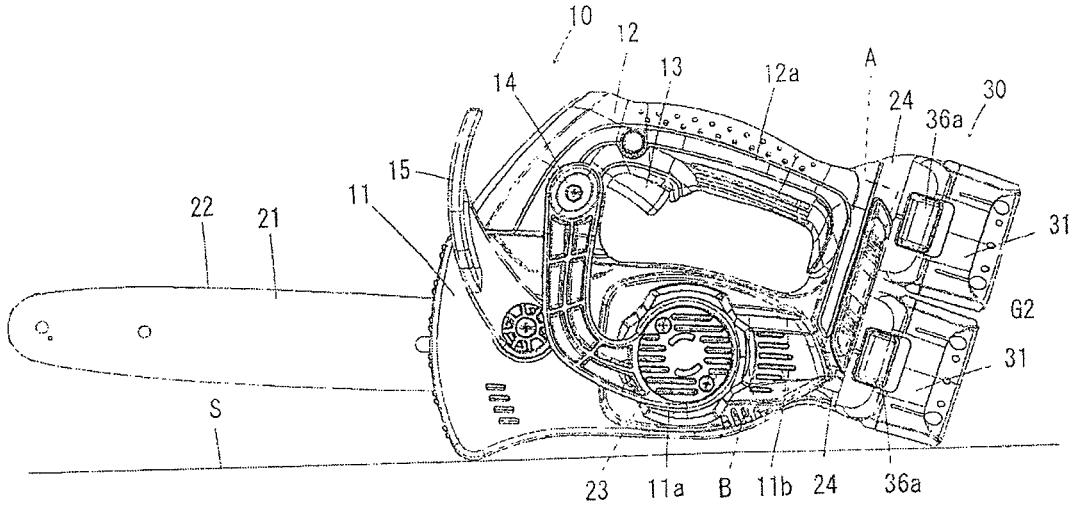
FIG. 16 is a left side view showing a position of a battery controller.

As shown in FIG. 16, it is preferable to provide the battery controller (united with or separated from the motor controller) in a position A adjacent the mounting position of the battery packs 31 thereby to shorten the wiring to the battery packs. In the case that the battery controller (united with or separated from the motor controller) is placed in a position B adjacent an exhaust opening 11*b*, the battery controller is cooled by the exhaust air. The battery controller may be provided in a passage of air caused by operation of a cooling fan driven by the electric motor 23 within the body housing 11.

In the case that the two battery packs 31, 31 in the chainsaw are connected in series, the electric motor 23 would not be activated if one of the battery packs was damaged or fully discharged. It is, therefore, preferable to provide an indicator of remaining power of each battery pack 31. The indicator is in the form of an indication panel 40 indicating an amount of remaining power or charge of each battery by plural bars. Preferably, the indication panel 40 is positioned to be visually recognized by the user when the battery packs are mounted in place.

Figure 17A:
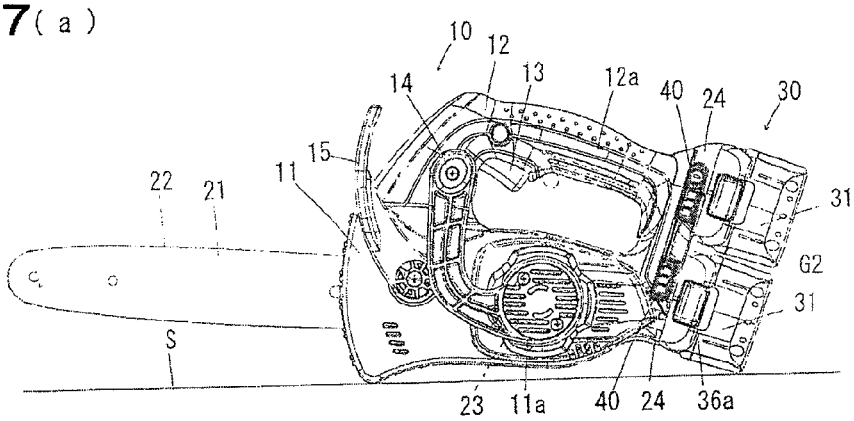
FIGS. 17(*a*), 17(*b*) and 17(*c*) illustrate indication panels indicative of remaining voltage of battery packs.
Figure 17B:
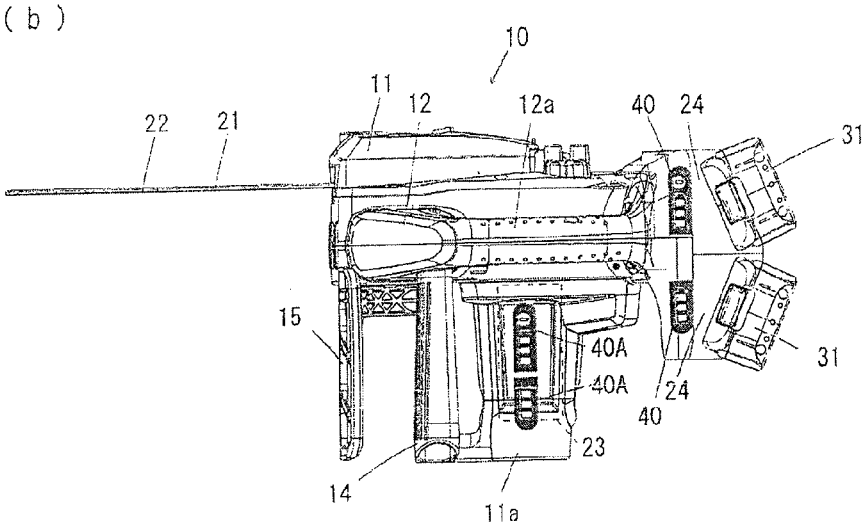
Figure 17C:
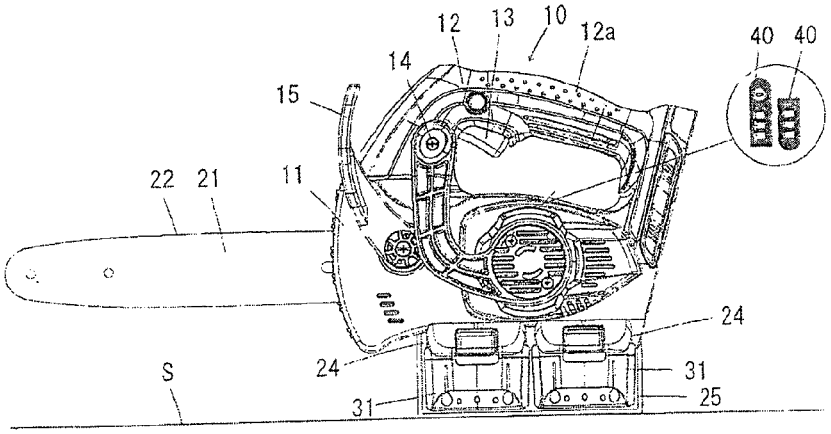

In the case that as shown in FIG. 17(*a*), the battery packs 31, 31 are mounted vertically in parallel to the back portion of body housing 11, the indication panels 40, 40 are mounted to the left side wall of body housing 11 in a vertical direction. In the case that as shown in FIG. 17(*b*), the battery packs 31 are mounted on the back portion of body housing 11, the indication panels 40, 40 are mounted in a left-and-right direction on the upper rear portion of body housing 11 or on the motor containing portion 11*a* to be visually recognized by the user during operation of the chainsaw.

In the case that as shown in FIG. 17(*c*), the battery packs 31, 31 are mounted in parallel to the bottom of body housing 11, the indication panels 40, 40 are mounted longitudinally on the motor containing portion of body housing 11 to be visually recognized by the user during operation of the chainsaw. As the indication panels 40, 40 are arranged in the same direction as the direction of battery packs 31, 31, the remaining power of the battery packs 31, 31 is instantly recognized. Although in the indication panel, the remaining power of the battery pack 31 is indicated by plural bars, a color or flashing speed of a lamp or an alarm tone may be applied to inform the operator.

What is claimed is:

1. A chainsaw comprising:

a body housing;

an elongated guide bar projecting forward from the body housing;

a saw-chain mounted to a periphery of the guide bar;

an electric motor mounted within the body housing for rotating the saw-chain along the periphery of the guide bar;

a top handle provided on an upper portion of the body housing in a fore-and-aft direction and located above the guide bar, the top handle being provided at an intermediate portion thereof with a gripe portion to be grasped by an operator; and a plurality of rechargeable battery packs detachably mounted on the body housing as a source of power supply to the electric motor, the battery packs being adapted to use in power tools, wherein a center of gravity of the chainsaw observed from the back side of the chainsaw is positioned at a distance from a centerline of said gripe portion extending between the centerline of said gripe portion and two times a lateral width of the gripe portion.

2. The chainsaw as claimed in claim 1, wherein the position of the center of gravity of the chainsaw observed from the back side of the chainsaw is offset from a vertical centerline of said gripe portion in a left-right direction.

3. The chainsaw as claimed in claim 1, wherein a center of gravity of each of said plurality of battery packs is positioned at a distance from the centerline of the gripe portion extending between the centerline of the gripe portion and the lateral width of the gripe portion.

4. The chainsaw as claimed in claim 1, wherein a switch for activating the electric motor is provided on a front portion of said gripe portion, and wherein the plurality of battery packs are arranged in such a manner that the center of gravity observed from one side of the chainsaw is positioned in a front-and-rear extent of 100 mm from a straight vertical line passing an immediate rear position of said switch.

5. The chainsaw as claimed in claim 1, wherein the plurality of battery packs includes two battery packs, and a center of gravity of each of the two battery packs is positioned at left and right sides of a vertical centerline of said gripe portion.

6. The chainsaw as claimed in claim 1, wherein said plurality of battery packs are mounted to a bottom portion of the body housing and arranged in such a manner that the center of gravity of the chainsaw is located at an upper side in an extent of said plurality of battery packs observed from a vertical direction.

7. The chainsaw as claimed in claim 1, wherein the plurality of battery packs are mounted to a lower portion of the body housing and arranged in such a manner that the lower portion of said body housing and the plurality of battery packs are grounded in a condition where the chainsaw is placed on a horizontal support surface of the ground.

8. The chainsaw as claimed in claim 1, wherein a protector member is provided to cover the plurality of battery packs when the plurality of battery packs are grounded in a condition where the chainsaw is placed on a horizontal support surface of the ground.

9. The chainsaw as claimed in claim 1, wherein the plurality of battery packs are arranged in parallel.

10. The chainsaw as claimed in claim 9, wherein a space between adjacent side walls of the plurality of battery packs arranged in parallel is less than 15 mm.

11. The chainsaw as claimed in claim 9, wherein a volume of each of the plurality of battery packs is more than 200 $cm^3$, and a space between adjacent side walls of the plurality of battery packs arranged in parallel is less than 15 mm.

12. The chainsaw as claimed in claim 1, wherein the body housing is provided with a plurality of attachments for mounting the plurality of battery packs thereto.

13. The chainsaw as claimed in claim 12, wherein the plurality of battery packs each are composed of a casing containing battery cells therein, an electric connector on a peripheral wall of the casing, and a pair of parallel rails arranged at both sides of the electric connector, and the plurality of attachments each are provided with a pair of guide rails for slide engagement with each pair of parallel rails of the plurality of battery packs.

14. The chainsaw as claimed in claim 13, wherein the plurality of battery packs each are provided with a hook retractably projected toward each of the plurality of attachments, and the plurality of attachments each are provided with a latch portion to be engaged with the hook for restricting slide movement of the rails of each battery pack on the guide rails of each attachment.

15. The chainsaw as claimed in claim 14, wherein each attachment is provided with a resilient member for biasing each battery pack mounted thereto in a removal direction.

16. The chainsaw as claimed in claim 15, wherein each attachment is provided with a battery pack container having an opening for inserting each battery pack along the guide rails.

17. The chainsaw as claimed in claim 1, wherein the plurality of battery packs are connected in series to the electric motor.

18. The chainsaw as claimed in claim 1, wherein the plurality of battery packs are connected in parallel to the electric motor.

* * * * *